US007219524B2

(12) United States Patent
Miyashita et al.

(10) Patent No.: US 7,219,524 B2
(45) Date of Patent: May 22, 2007

(54) METHOD FOR MANUFACTURING HIGH-PRESSURE PIPING PART AND STRUCTURE THEREOF

(75) Inventors: Shu Miyashita, Anjo (JP); Masami Tanaka, Okazaki (JP); Toshihiro Imai, Kani (JP); Hirofumi Muranaka, Kariya (JP)

(73) Assignee: Denso Corporation (JP)

( * ) Notice: Subject to any disclaimer, the term of this patent is extended or adjusted under 35 U.S.C. 154(b) by 0 days.

(21) Appl. No.: 11/305,040

(22) Filed: Dec. 19, 2005

(65) Prior Publication Data

US 2006/0137423 A1 Jun. 29, 2006

(30) Foreign Application Priority Data

Dec. 24, 2004 (JP) ..... 2004-374696

(51) Int. Cl.
*B21D 28/00* (2006.01)

(52) U.S. Cl. ..... 72/340; 72/354.6; 72/359

(58) Field of Classification Search ..... 72/355.6, 72/358, 359, 352, 368, 354.6, 354.8, 355.2, 72/355.4, 340; 29/890.142, 889.5
See application file for complete search history.

(56) References Cited

U.S. PATENT DOCUMENTS 4,305,273 A 12/1981 Martin
4,768,369 A * 9/1988 Johnson et al. ..... 72/368
5,472,142 A 12/1995 Iwanaga
5,493,888 A * 2/1996 Merkle et al. ..... 72/359
6,223,726 B1 5/2001 Jung et al.
6,470,855 B1 10/2002 Frank et al.
6,666,390 B2 12/2003 Itou

FOREIGN PATENT DOCUMENTS

DE 295 21 402 U1 4/1997

OTHER PUBLICATIONS

European Search Report dated Apr. 26, 2006.

* cited by examiner

*Primary Examiner*—Lowell A. Larson
*Assistant Examiner*—Debra Wolfe
(74) *Attorney, Agent, or Firm*—Nixon & Vanderhye PC

(57) ABSTRACT

A high-pressure piping part includes a body structure forged in a closed space. The body structure is formed to include a main body portion formed by forward extrusion and side arm portions formed by side extrusion. The main body portion has therein a fiber flow formed along a passage, and the side arm portion has therein a fiber flow formed along the passage. Therefore, the direction in which stress is applied to the passage of the body structure by an internal pressure is approximately perpendicular to the directions of the fiber flows, thereby improving the degree of allowance of the resistance to pressure of the body structure for an injector.

18 Claims, 5 Drawing Sheets

METHOD FOR MANUFACTURING HIGH-PRESSURE PIPING PART AND STRUCTURE THEREOF

CROSS REFERENCE TO RELATED APPLICATION

This application is based on Japanese Patent Application No. 2004-374696 filed on Dec. 24, 2004, the contents of which are incorporated herein by reference in its entirety.

FIELD OF THE INVENTION

The present invention relates to a method for manufacturing a high-pressure piping part and a high-pressure piping part manufactured by the method and, in particular, is suitably applied to a high-pressure piping part for an internal combustion engine.

BACKGROUND OF THE INVENTION

For example, a high-pressure piping part having therein a passage for passing high-pressure fuel to be supplied to an internal combustion engine is a constituent part for forming a body of an injector for a diesel engine.

Generally, in a case of manufacturing this piping part, because of convenience in terms of equipment, a billet 101 shaped like a circular column shown in FIG. 11A is forged in a radial direction in a half closed manner to form a forged body 102 as shown in FIG. 11B. Then, a flash (burr) 103 and the like are trimmed to form a body structure 110. Then, a passage for passing high-pressure fuel is formed in this body structure 110.

The fuel flowing through the passage of this injector body has a very high pressure (for example, pressure of 180 MPa) and hence a large degree of allowance is provided to the resistance to pressure of the injector body.

In recent years, in order to respond to a trend toward larger power and cleaner exhaust gas of a diesel engine, the pressure of fuel to be supplied has been desired to be further increased. However, it is difficult to further improve the resistance to pressure of the injector body of a high-pressure piping part manufactured by the above-mentioned manufacturing method in the related art. Hence, there is presented a problem that it is difficult to secure the same degree of allowance of the resistance to pressure as ever.

SUMMARY OF THE INVENTION

The present inventors earnestly studied measures to improve the degree of allowance of the resistance to pressure of a body structure. As a result, the present inventors found that the fracture of the body structure in a high internal pressure test for checking the degree of allowance of resistance to pressure easily developed when the direction in which stress was applied to the body structure by the internal pressure agreed with the direction of fiber flow of the body structure. That is, the present inventors found that by controlling the fiber flow, the degree of allowance of the resistance to pressure of an injector body of a high-pressure piping part could be improved.

In view of the above-described problems, it is an object of the present invention to provide a method for manufacturing a piping part for a high-pressure fluid, in which a degree of allowance of resistance to pressure is improved.

It is another object of the present invention to provide a piping part for a high-pressure fluid, which can effectively improve a degree of allowance of resistance to pressure.

According to the present invention, a method for manufacturing a piping part for a high-pressure fluid, includes a step of arranging a billet made of a raw material in a closed space within a die, and a step of forming a body structure before a passage for the high-pressure fluid is formed by pressing a punch to the billet after the arranging step to plastically deform the billet. Further, in the forming step, the billet is plastically deformed in such a way that fiber flows along the passage are formed in the body structure.

Because the fiber flows of the body structure forged in the closed space is along the passage for the high-pressure fluid, the direction in which stress is applied to the passage by an internal pressure is approximately perpendicular to the directions of the fiber flows. In this manner, the degree of allowance of the resistance to pressure of the body structure can be effectively improved in the piping part.

For example, the closed space within the die includes a forward extrusion portion in which the billet is arranged in the arranging step and which extends to plastically deform the billet in a pressing direction of the punch in the forming step, and a side extrusion portion branching from the forward extrusion portion in such a way as to plastically deform the billet in a direction different from the pressing direction of the punch in the forming step. In this case, in the forming step, the body structure is formed to include a main portion that is plastically deformed in correspondence with the forward extrusion portion and has therein the fiber flow along the passage, and a side arm portion that is plastically deformed in correspondence with the side extrusion portion and has therein the fiber flow along the passage. Therefore, the body structure having the main portion and the side arm portion branching from the main portion can improve the degree of allowance of the resistance to pressure of the high-pressure piping part.

The side extrusion portion can be formed to extend in a direction approximately perpendicular to an extending direction in which the forward extrusion portion extends. In this case, during the forming step, the billet in the forward extrusion portion can be easily plastically deformed from the forward extrusion portion to the side extrusion portions. Therefore, the fiber flow along the passage can be stably formed in the side arm portion formed in the side extrusion portion.

For example, the side extrusion portion includes a plurality of extrusion parts. In this case, in the forming step, the billet can be plastically deformed in balance in a circumferential direction of an axis of the forward extrusion portion from the forward extrusion portion to the plurality of extrusion parts. According to this, the plastically deformed portions of the billet entering from the forward extrusion portion into the plurality of side extrusion portions are in balance in the circumferential direction of the axis of the forward extrusion portion and hence the fiber flow of the main portion formed in the forward extrusion portion is not disturbed. Therefore, the fiber flow along the passage can be stably formed in the main portion of the body structure. Alternatively, the plurality of extrusion parts can be arranged at equal intervals in the circumferential direction of the axis of the forward extrusion portion. In this case, the fiber flow along the passage can be stably formed in the main portion of the body structure having the side arm portions.

Furthermore, the billet arranged in the forward extrusion portion in the arranging step is provided with a fiber flow in the pressing direction of the punch. In this case, it is extremely easy to stably form the fiber flow along the passage in the main portion of the body structure.

According to another aspect of the present invention, a piping part for a high-pressure fluid includes a body structure forged in a closed space, and the body structure includes a passage through which the high-pressure fluid flows and a plurality of fiber flows provided along the passage. Therefore, it is possible to improve the degree of allowance of the resistance to pressure of the high-pressure piping part. The body structure can include a main portion extending in an extending direction, and a side arm portion branching from the main portion and extending in a directions different from the extending direction of the main portion. In this case, the fiber flows along the passage can be provided in the main portion and the side arm portion.

In the present invention, the high-pressure fluid can be suitably used as fuel for an internal combustion engine.

BRIEF DESCRIPTION OF THE DRAWINGS

The above and other objects, features and advantages of the present invention will become more apparent from the following detailed description of preferred embodiments made with reference to the accompanying drawings, in which.

DETAILED DESCRIPTION OF PREFERRED EMBODIMENTS

Preferred embodiments of the present invention will be described with reference to the drawings.

A high-pressure piping part in an embodiment is a body of an injector for injecting high-pressure fuel (for example, light oil of a pressure of 200 MPa) into a diesel engine of an internal combustion engine.

Figure 1:
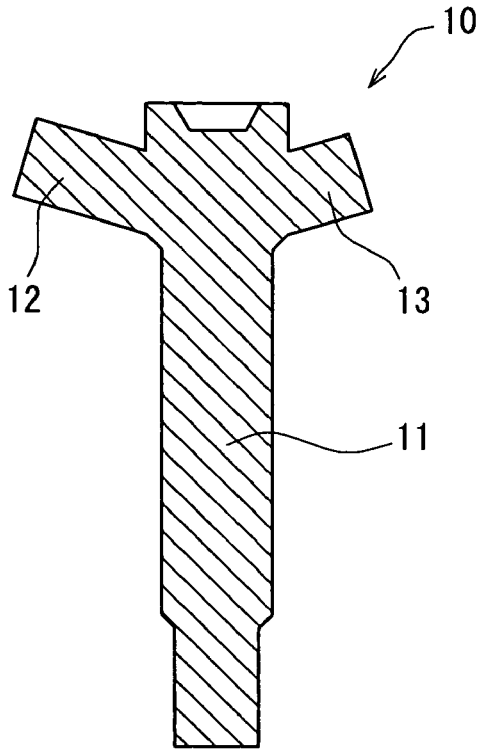
FIG. 1 is a schematic longitudinal sectional view showing a body structure of a high-pressure piping part in a preferred embodiment to which the present invention is applied.
Figure 2:
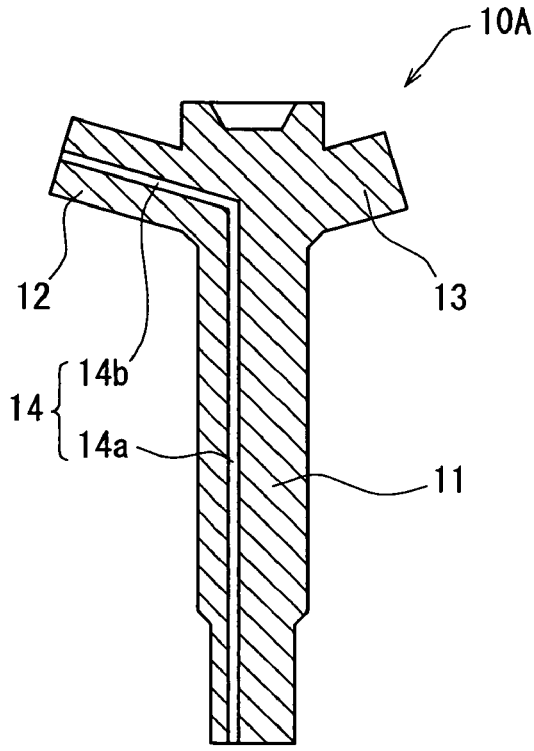
FIG. 2 is a schematic longitudinal sectional view showing a body having a passage formed in the body structure.
Figure 3:
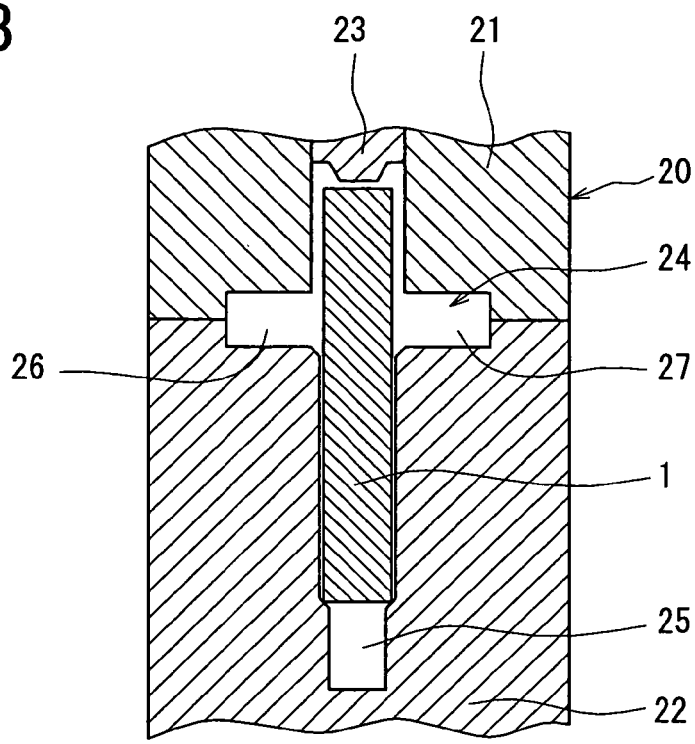
FIG. 3 is a sectional view showing a step for forging the body structure.
Figure 4:
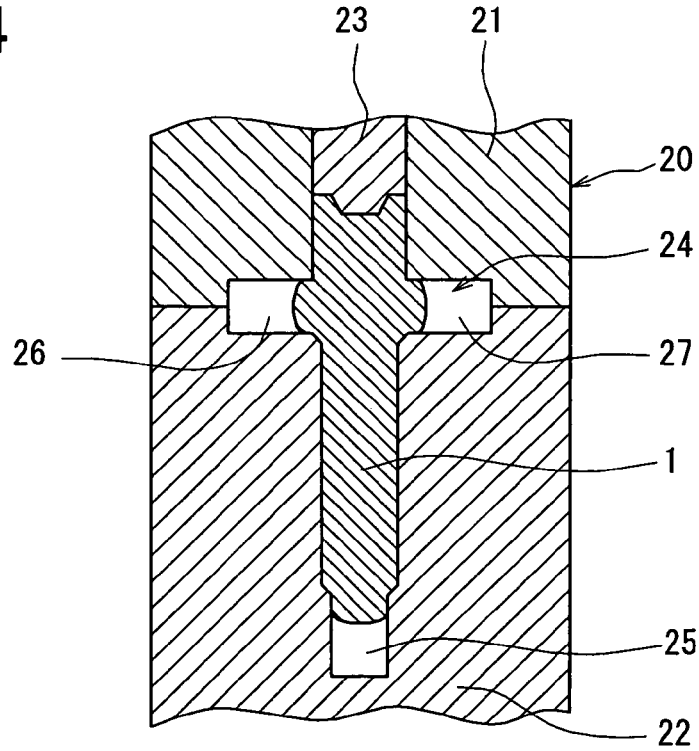
FIG. 4 is a sectional view showing a step for forging the body structure.
Figure 5:
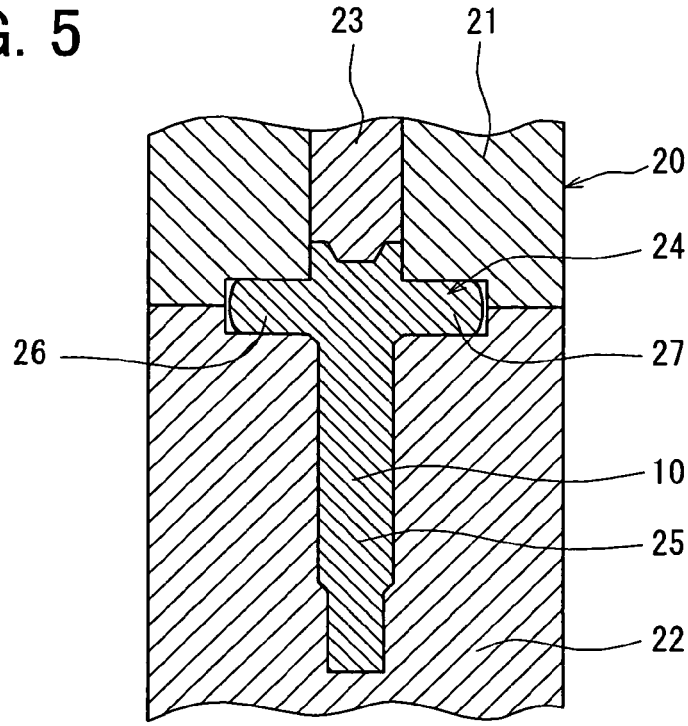
FIG. 5 is a sectional view showing a step for forging the body structure.

FIG. 1 is a longitudinal sectional view showing a schematic structure of a body structure 10 before a passage is formed in an injector body. FIG. 2 is a longitudinal sectional view showing a schematic structure of a body 10A in which a passage 14 is formed in the body structure 10. Then, FIG. 3 to FIG. 5 are sectional views showing respective steps that show a method for forging the body structure 10 and including a die 20.

As shown in FIG. 1, in the body structure 10, a main body portion 11 that is nearly shaped like a circular column which extends in the up and down directions in the drawing having an inclined stepped portion formed at a middle portion, and a pair of side arm portions (side branch portions) 12, 13 that branch from the main body portion 11 extending to the sides upward in the drawing, are formed integrally with each other.

The body structure 10 is formed of steel (SCM 415 in this embodiment) and is formed in the shape shown in FIG. 1. Then, a passage 14 for passing high-pressure fuel is drilled as shown in FIG. 2, thereby the body structure 10 is formed into the body 10A.

Next, a method for forging the body structure 10 using a die 20 will be described.

As shown in FIG. 3, the die 20 is a closed forging die constructed of an upper die 21, a lower die 22, and a punch 23. The punch 23 of this embodiment is provided in the upper die 21 and is so constructed as to be able to move back and forth toward a die space (product portion) 24 of a closed space formed when the upper die 21 and the lower die 22 are matched with each other.

The die space 24 is formed by a forward extrusion portion 25 extending in the up and down directions in the drawing and by a pair of side extrusion portions 26, 27 branching from the forward extrusion portion 25 and extending in the left and right directions (i.e., directions perpendicular to a direction in which the forward extrusion portion 25 extends) in the drawing.

The pair of side extrusion portions 26, 27 are formed at symmetric positions across the forward extrusion portion 25 (positions symmetric with respect to the axis of the forward extrusion portion 25). That is, the two extrusion portions 26, 27 are arranged equally in the circumferential direction of the axis of the forward extrusion portions 25.

When the body structure 10 is manufactured by the use of the die 20 constructed in the above-described manner, as shown in FIG. 3, the upper die 21 and the lower die 22 are matched to each other to confine a billet 1 of a raw material in the forward extrusion portion 25 of the die space 24.

This billet 1 is a circular column-shaped member made of the above-mentioned steel (SCM 415 in this embodiment) and is prepared by cutting a round bar in a specified length by a billet shear or the like.

Moreover, this billet 1 has an outside diameter that is a little smaller than the inside diameter of the forward extrusion portion 25 (specifically, inside diameter of a middle portion in the up and down directions in the drawing) and hence can be easily inserted into an elongated hole forming the forward extrusion portion 25. Then, after the billet 1 is inserted into the elongated hole, the axis of the billet 1 can be easily consistent with the axis of the forward extrusion portion 25.

When the billet 1 is arranged in the die space 24 of the die 20, as shown in FIG. 4, the punch 23 is moved down, thereby being pressed into the billet 1. When the punch 23 is pressed into the billet 1, the billet 1 is plastically deformed downward in the forward extrusion portion 25 and is plastically deformed to the sides in the side extrusion portions 26, 27.

When the punch 23 is further pressed into the billet 1, as shown in FIG. 5, the plastic deformation proceeds to bring about a state where the material forming the billet 1 (i.e., material to be processed) nearly fills the die space 24, whereby the body structure 10 is formed.

Figure 6:
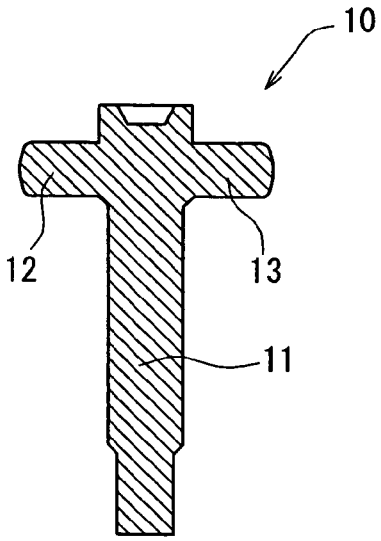
FIG. 6 is a schematic longitudinal sectional view showing the body structure separated from a die.
Figure 7:
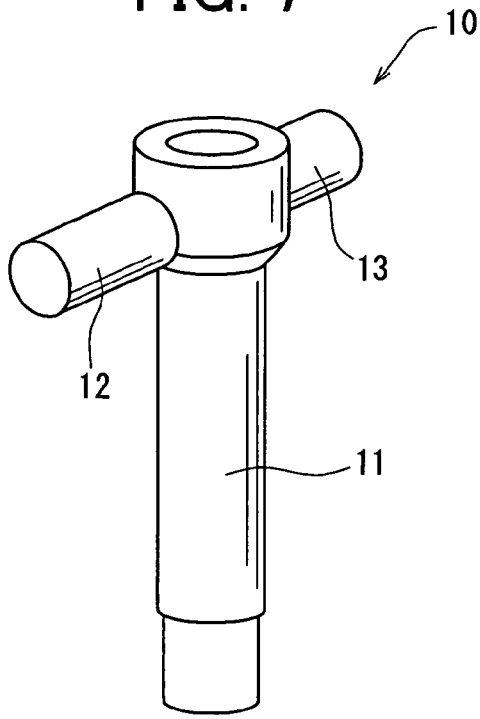
FIG. 7 is a schematic perspective view showing the body structure separated from the die.

When the forging is completed as shown in FIG. 5, the upper die 21 and the lower die 22 are opened and a forged body is separated from the dies, whereby the body structure 10 whose longitudinal sectional view is shown in FIG. 6 and whose perspective view is shown in FIG. 7 can be obtained.

This body structure 10 is constructed with the main body portion 11 plastically deformed in correspondence with the forward extrusion portion 25 of the die space 24 and side arm portions 12, 13 plastically deformed in correspondence with the side extrusion portions 26, 27. That is, the body structure 10 is constructed of the main body portion 11 extending in one direction (in the up and down directions in FIG. 6) and the pair of side arm portions 12, 13. The side arm portions 12, 13 branch from the main body portion 11, extend in a direction perpendicular to a direction in which the main body portion 11 extends, and are arranged at symmetric positions with respect to the main body portion 11.

The step shown in FIG. 3 is an arranging step in the present embodiment, and steps shown in FIG. 4 and FIG. 5 show a forming step in the present embodiment.

Here, the billet 1 arranged in the die space 24 in the arranging step shown in FIG. 3 is heated to a temperature range between 750° C. and 800° C. It is preferable that the temperature of the billet 1 forged in the present embodiment is between 600° C. and 950° C.

When the temperature of the billet 1 is lower than 600° C., ductility is little and hence forging is difficult. When the temperature of the billet 1 is higher than 950° C., forging accuracy becomes lower. From the viewpoint of the ease of forging and forging accuracy, the temperature of the billet 1 is preferably in a range between 600° C. and 950° C., and more preferably in a range between 750° C. and 800° C.

Both the side arm portions 12, 13 of the body structure 10 formed in this manner are bent upward in FIG. 6 by pressing or the like to produce the substantial body structure 10 shown in FIG. 1.

The body structure 10 shown in FIG. 1 is subjected to normalizing work and then has a passage 14 formed by drilling or the like to form a body 10A shown in FIG. 2. The body 10A is subjected to carburizing and hardening work. Then, other injector constituent parts are assembled therewith.

Here, the formation of a fiber flow in the forging step shown in FIG. 3 to FIG. 5 will be described.

In FIG. 3, the billet 1 arranged in the die space 24 is prepared by cutting a round bar and has a fiber flow in the up and down directions shown in FIG. 3.

When the billet 1 is being plastically deformed in the manner shown in FIG. 4 and FIG. 5, the material to be processed is plastically deformed downward in the drawing in the forward extrusion portion 25 and hence a fiber flow extending in the up and down directions is formed. Because a fiber flow extending in the up and down directions is already formed in the billet 1 before the billet 1 is plastically deformed, a stable fiber flow is easily formed in the up and down directions (i.e., directions in which the forward extrusion portion 25 extends) in the forward extrusion portion 25.

Meanwhile, because the material to be processed is plastically deformed in the left and right directions in the drawing in the side extrusion portions 26, 27, a fiber flow extending in the left and right directions in the drawing is formed.

Because both side extrusion portions 26, 27 extend nearly in directions perpendicular to the axial direction (i.e., extending direction) of the forward extrusion portion 25, the material to be processed is plastically deformed with stability from the forward extrusion portion 25 to both the side extrusion portions 26, 27. Hence, as compared with a case where the directions in which the side extrusion portions 26, 27 extend is inclined to the axial direction of the forward extrusion portion 25, a stable fiber flow is formed in the directions in which the side extrusion portions 26, 27 extend.

Moreover, both the side extrusion portions 26, 27 branch from the forward extrusion portion 25 at symmetric positions (positions at equal distances in the circumferential direction of the axis) on the same height positions in the axial direction of the forward extrusion portion 25. Therefore, when the material to be processed is plastically deformed in the side extrusion portions 26, 27, the material to be processed enters from the forward extrusion portion 25 into both the side extrusion portions 26, 27 in good balance and hence does not disturb the fiber flow of the material to be processed at the points where the side extrusion portions 26, 27 branch from the forward extrusion portion 25.

Figure 8:
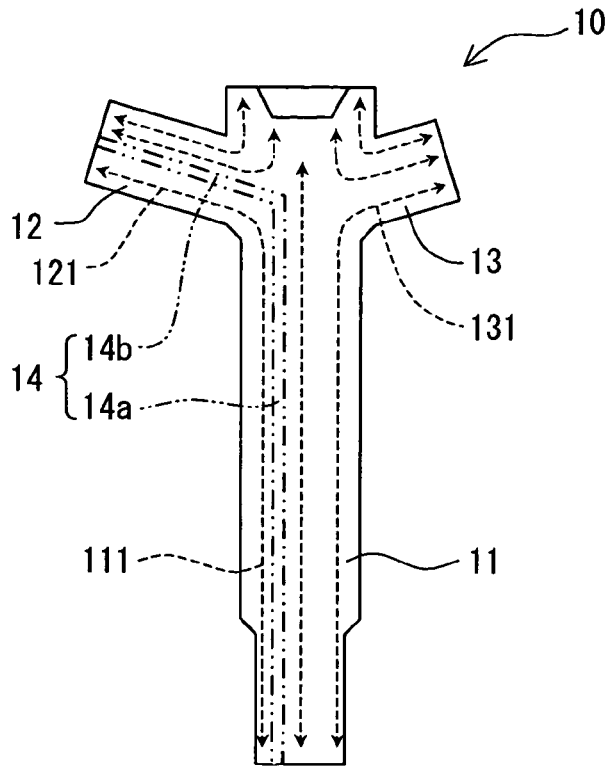
FIG. 8 is a schematic diagram showing the direction of the fiber flow of the body structure.

Hence, as shown in FIG. 8, in the body structure 10, a fiber flow 111 is formed in the main body portion 11 in directions shown by broken lines along the direction in which the main body portion 11 extends and fiber flows 121, 131 are formed in the side arm portions 12, 13 in directions shown by broken lines along the directions in which the side arm portions 12, 13 extend.

As shown in FIG. 2 and shown by double dot and dash lines in FIG. 8, in the body structure 10, a passage 14*a* is formed in the main body portion 11 in the direction in which the main body portion 11 extends and a passage 14*b* is formed in the side arm portion 12 in the direction in which the side arm portion 12 extends.

That is, the fiber flow 111 along the passage 14*a* is formed in the main body portion 11, and the fiber flow 121 along the passage 14*b* is formed in the side arm portion 12.

According to the above-mentioned structure and manufacturing method, in the main body portion 11 and the side arm portion 12 of the body structure 10, the fiber flows 111, 121 are along the passage 14 (i.e., passage 14*a* and passage 14*b*) formed in the main body portion 11 and the side arm portion 12 of the body structure 10. Hence, the direction in which stress is applied to the passage 14 by an internal pressure due to the high-pressure fuel is approximately perpendicular to the directions of the fiber flows 111, 121.

When the fiber flows are formed, nonmetallic inclusions such as sulfur and the like causing fatigue fracture in the billet (material to be processed) 1 are stretched along the fiber flows (i.e., flow of the material to be processed). Therefore, fracture strength becomes comparatively larger in a case where the direction in which stress is applied to the passage 14 by the internal pressure does not agree with the direction of the fiber flow.

According to the present embodiment, the direction in which stress is applied to the passage 14 by the internal pressure is nearly perpendicular to the directions of the fiber flows 111, 121 and hence the degree of allowance of the resistance to pressure of the body 10A for the injector can be increased.

Figure 11A:
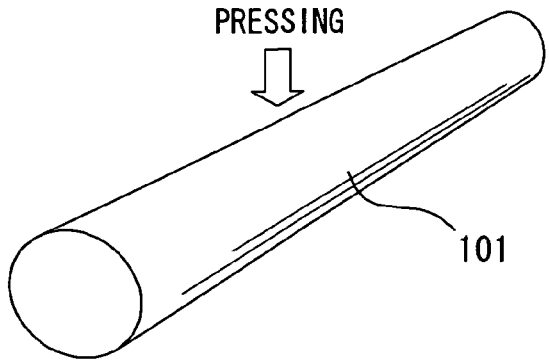
FIG. 11A RELATED ART
FIGS. 11A and 11B are diagrams showing a method for forming a body structure by a half-closed forging in a related art.
Figure 11B:
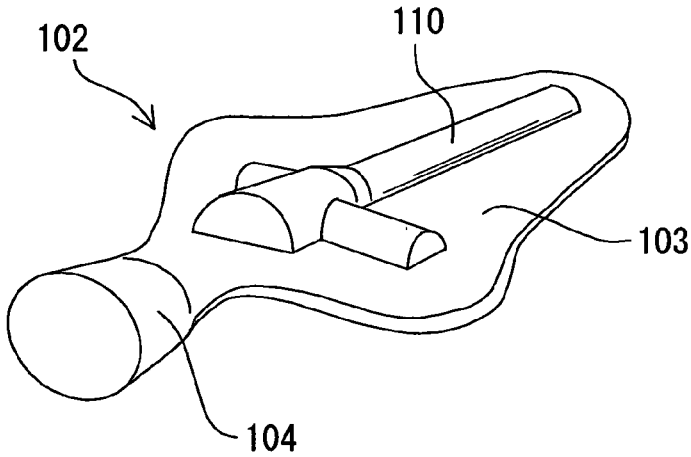
FIG. 11B RELATED ART
Figure 12:
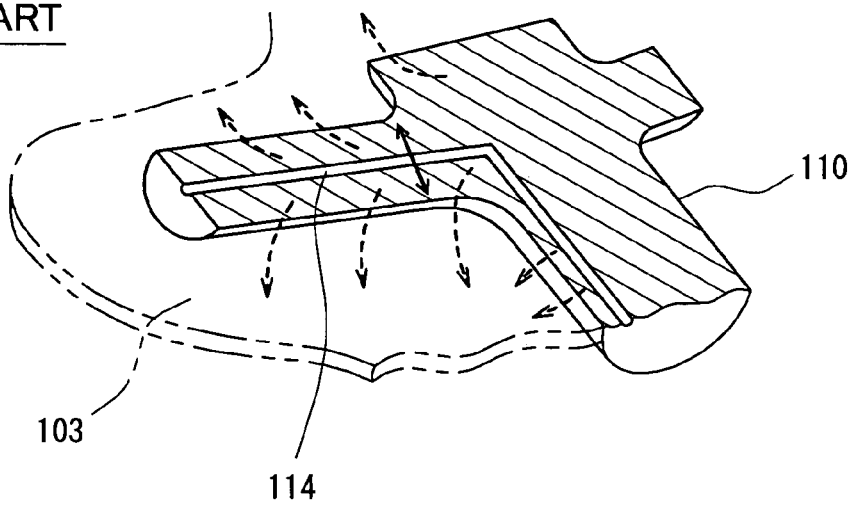
FIG. 12 RELATED ART
FIG. 12 is a diagram showing the direction of the fiber flow of a body structure according to the method in FIGS. 11A and 11B.

When a body structure 110 is formed by a half-closed forging method shown in FIG. 11B, as shown by broken lines with arrows in FIG. 12, fiber flows are formed from the body structure 110 toward a flash 103 and hence the direction in which stress is applied to the passage 114 by the internal pressure (direction shown by a solid line with arrows) easily agree with the directions of the fiber flows.

The present inventors conducted the test of applying internal pressure repetitively on the body structure 10 manufactured by the present embodiment and on the body structure 110 manufactured by the forging method shown in FIG. 11B and found that pressure resistance strength was approximately 10% larger in the body structure 10 manufactured by the present embodiment than in body structure 110 manufactured by the method shown in FIG. 11B.

In recent years, the request of increasing the pressure of fuel supplied to an internal combustion engine has increased and hence the effect of increasing the degree of allowance of the resistance to pressure of the body 10A for the injector is extremely large.

It is possible to form the main portion and the side arm portion from separate parts and to combine them into one part by a fastening structure by screwing to form a body for an injector in which a fiber flow is along the passage. However, in this case, when the fuel pressure increases, it is difficult to secure the reliability of the resistance to pressure of portions fastened to each other by screwing. The body 10A for an injector according to the present embodiment in which the main body portion 11 and the side arm portion 12 are integrally formed has an advantage in the reliability of resistance to pressure.

Moreover, according to the structure and the manufacturing method of the present embodiment, the flash 103 formed in the method shown in FIG. 11B is not formed and hence material loss can be reduced and the step of trimming the flash 103 can be eliminated.

Furthermore, a raw material can be set by inserting the billet 1 into the forward extrusion portion 25 and hence such a gripping portion 104 for setting the raw material that is required in the conventional method as shown in FIG. 11B is not required. Therefore, material loss can be further reduced.

Still furthermore, in contrast to the case of applying the conventional method, the body structure 10 can be formed with higher accuracy. In particular, a portion lower than the side arm portions 12, 13 of the main body portion 11 of the body structure 10 is formed in one depressed space of the lower die 22 and hence can be formed with extremely high accuracy. Therefore, this can eliminate the need for cutting its outer peripheral surface and hence can reduce load in post-working by a large amount.

Still furthermore, when the passage 14 is formed in the body structure 10 by drilling, a drill is moved along the fiber flows 111, 121 and hence can be accurately moved in a straight line. Therefore, the passage 14 can be also formed with high accuracy.

Other Embodiments

Although the present invention has been described in connection with the preferred embodiment thereof with reference to the accompanying drawings, it is to be noted that various changes and modifications will become apparent to those skilled in the art.

For example, in the above-mentioned embodiment, the side extrusion portions 26, 27 in the die space 24 are formed at the symmetric positions across the forward extrusion portion 25. That is, the side extrusion portions 26, 27 in the die space 24 are formed at symmetric positions with respect to the axis of the forward extrusion portion 25. Furthermore, the body structure 10, constructed of the main body portion 11 extending in the up and down directions and the pair of side arm portions 12, 13 branching from the main body portion 11 and arranged at symmetric positions with respect to the main body portion 11, is forged. However, the side extrusion portions of the die space, that is, the side arm portions of the structure to be forged are not limited to two portions but may be three or more portions.

Figure 9:
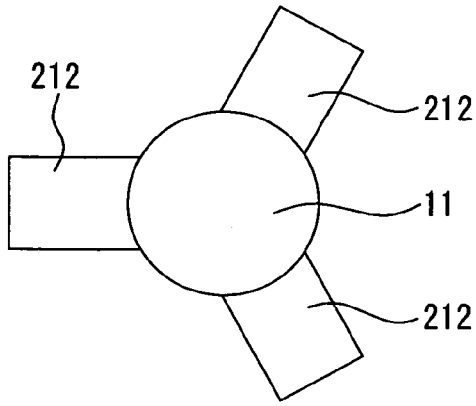
FIG. 9 is a top plan view showing a body structure according to a modification of the present invention.

For example, as shown by the top plan view in FIG. 9, the body structure 10 may have a plurality of side arm portions 212 (e.g., three arm portions in FIG. 3) formed at equal intervals in the circumferential direction of the axis of the main body portion 11. Also in this case, the material to be processed enters from the forward extrusion portion into three side extrusion portions uniformly (in good balance) and hence the fiber flow of the material to be processed is not disturbed at the points where the side arm portions 212 branch from the main body portion 11.

Figure 10:
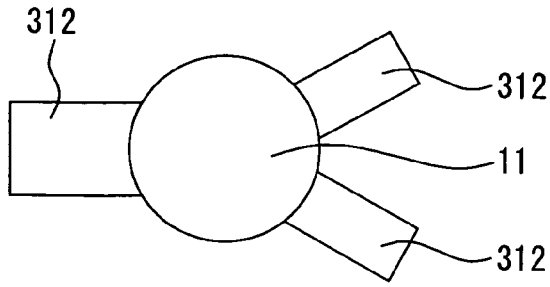
FIG. 10 is a top plan view showing a body structure according to another modification of the present invention.

Moreover, when the material to be processed enters in good balance from the forward extrusion portion into a plurality of side extrusion portions, for example, even if the side arm portions 312 branch from the main body portion 11 as shown by the top plan view in FIG. 10, the fiber flow of the material to be processed is not disturbed at the points where the side arm portions 312 branch from the main body portion 11.

Furthermore, in the above-mentioned embodiment, the die 20 is divided into the upper and lower dies 21, 22 and the punch 23 is provided on the side of the upper die 21. However, it is not intended to limit the structure of the die to this but any structure may be employed if a material to be processed can be forged in a closed space. For example, the structure of the die may be of the type in which the die is divided into left and right dies or of the type in which the die is divided into three parts. In addition, the die may be provided with a plurality of punches.

Still furthermore, in the above-mentioned embodiment, the forward extrusion of forming the main body portion 11 and the side extrusion of forming the side arm portions 12, 13 are performed at the same time, but they may be performed separately. It is also recommended that after the forward extrusion is performed, the side extrusion can be performed.

Still furthermore, in the above-mentioned embodiment, the material to be processed of the billet 1 is SCM415 but may be other material. For example, the material to be processed may be steel such as S45C or SCM435.

Still furthermore, in the above-mentioned embodiment, the high-pressure piping part forged in the closed space is the injector body structure for the internal combustion engine (diesel engine) but the present invention can be effectively applied to the other high-pressure piping parts.

For example, the present invention may be applied to a common rail for distributing and supplying fuel to an injector and may be applied to piping parts for passing other high-pressure fluid. In addition, the shape of the high-pressure piping part is not limited to the structure constructed of the main portion and the side arm portion.

While the invention has been described with reference to preferred embodiments thereof, it is to be understood that the invention is not limited to the preferred embodiments and constructions. The invention is intended to cover various modification and equivalent arrangements. In addition, while the various elements of the preferred embodiments are shown in various combinations and configurations, which are preferred, other combinations and configuration, including more, less or only a single element, are also within the spirit and scope of the invention.

What is claimed is:

1. A method for manufacturing a piping part for a high-pressure fluid, the method comprising the steps of:

providing a die constructed with a first die part and a second die part defining a closed space;

arranging a billet made of a raw material in the closed space within the die; and forming a body structure before a passage for the high-pressure fluid is formed, by pressing a punch to the billet after the arranging step to plastically deform the billet, wherein:

in the forming step, the billet is plastically deformed in such a way that fiber flows along an area where the passage is to be formed in the body structure, wherein:

the closed space within the die includes:

a forward axially extending extrusion portion in which the billet, axially extending in the axial direction of the forward extension portion, is arranged in the arranging step and which extends to plastically deform the billet in a pressing direction of the punch in the forming step, and a side extrusion portion defined between the first die part and second die part and branching from the forward extrusion portion in such a way as to plastically deform the billet in a direction different from the pressing direction of the punch in the forming step; and the forming step includes a step of pressing the billet in said axial direction so that the body structure is formed to include a main portion that is plastically deformed in correspondence with the forward extrusion portion and has therein the fiber flow along the area where the passage thereof is to be formed, and a side arm portion that is plastically deformed in correspondence with the side extrusion portion and has therein the fiber flow along the area where the passage thereof is to be formed.

2. The method for manufacturing a piping part as in claim 1, wherein the side extrusion portion extends in a direction approximately perpendicular to an extending direction in which the forward extrusion portion extends.

3. The method for manufacturing a piping part as in claim 1, wherein:

the side extrusion portion includes a plurality of extrusion parts; and in the forming step, the billet is plastically deformed in balance in a circumferential direction of an axis of the forward extrusion portion from the forward extrusion portion to the plurality of extrusion parts.

4. The method for manufacturing a piping part as in claim 1, wherein:

the side extrusion portion includes a plurality of extrusion parts; and the plurality of extrusion parts are arranged at equal intervals in a circumferential direction of an axis of the forward extrusion portion.

5. The method for manufacturing a piping part as in claim 1, wherein the fiber flows are formed in the pressing direction of the punch in the billet arranged in the forward extrusion portion in the arranging step.

6. The method for manufacturing a piping part as in claim 1, further comprising forming the passage including a first passage part provided in the main portion and a second passage part provided in the side arm portion, by drilling; and the drilling is performed by moving a drill along the fiber flows after the fiber flows are formed.

7. The method for manufacturing a piping part as in claim 6, further comprising bending the side arm portion by pressing.

8. The method for manufacturing a piping part as in claim 1, wherein:

in the forming step, the pressing is performed while heating the billet in a temperature range of 600° C.–950° C.

9. The method for manufacturing a piping part as in claim 8, wherein:

in the forming step, the pressing is performed while heating the billet in a temperature range of 750° C.–800° C.

10. The method for manufacturing a piping part as in claim 1, wherein the high-pressure fluid is fuel for an internal combustion engine.

11. The method for manufacturing a piping part as in claim 1, wherein the billet has an approximately cylindrical shape extending in said axial direction.

12. The method for manufacturing a piping part as in claim 1, further comprising a step of integrally forming a connector with the side arm portion.

13. The method for manufacturing a piping part as in claim 3, wherein the side extrusion portion includes a plurality of extrusion parts.

14. The method for manufacturing a piping part as in claim 13, wherein in the forming step, the billet is plastically deformed in balance in a circumferential direction of an axis of the forward extrusion portion from the forward extrusion portion to the plurality of extrusion parts.

15. The method for manufacturing a piping part as in claim 13, the plurality of extrusion parts are arranged at equal intervals in a circumferential direction of an axis of the forward extrusion portion.

16. The method for manufacturing a piping part as in claim 1, wherein the billet is prepared by cutting a round bar to a specified length.

17. The method for manufacturing a piping part as in claim 1, wherein the billet is made of steel.

18. The method for manufacturing a piping part as in claim 1, wherein the punch is provided in the upper die and is constructed and arranged to move back and forth along the axis of the forward extension portion.

* * * * *